United States Patent [19]

Lamberty et al.

[11] Patent Number: 4,885,556

[45] Date of Patent: Dec. 5, 1989

[54] CIRCULARLY POLARIZED EVANESCENT MODE RADIATOR

[75] Inventors: Bernard J. Lamberty, Kent; Steven J. Peters, Renton, both of Wash.

[73] Assignee: The Boeing Company, Seattle, Wash.

[21] Appl. No.: 265,538

[22] Filed: Nov. 1, 1988

[51] Int. Cl.[4] ..... H01P 1/16

[52] U.S. Cl. ..... 333/21 A; 333/208; 333/246; 333/248; 343/756; 343/786

[58] Field of Search ..... 333/21 R, 21 A, 24 C, 333/26, 208, 246, 248, 250, 252; 343/756, 785, 786

[56] References Cited

U.S. PATENT DOCUMENTS

| | | | |
|---|---|---|---|
| 3,732,508 | 5/1973 | Ito et al. | 333/21 R |
| 3,758,882 | 9/1973 | Mörz | 333/21 A |
| 3,925,740 | 12/1975 | Steensma | 333/24 C X |
| 4,344,048 | 8/1982 | Mörz | 333/21 A X |

OTHER PUBLICATIONS

*Reference Data for Radio Engineers,* Int. Tel. & Tel. Corp. (Federal Tel. & Radio Corp., 1957), pp. 164–173.

Craven, *Waveguide Below Cutoff: A New Type of Microwave Integrated Circuit,* Microwave Journal, vol. 13, No. 8, Aug. 1970, pp. 51–58.

Craven et al, *Evanescent Mode Microwave Components,* Artech House, 1987, Chapter 7, pp. 121–122.

*Primary Examiner*—Paul Gensler

*Attorney, Agent, or Firm*—Lisa and Associates

[57] ABSTRACT

A nearly square waveguide below cutoff has a microstrip substrate disposed diagonally therein. A first shunt capacitance is provided by either a conductor formed on the microstrip substrate or a conductor disposed in the waveguide perpendicular to the microstrip substrate. A dielectric window is disposed in the end to provide a shunt capacitance at the opposite end of the waveguide.

15 Claims, 5 Drawing Sheets

-PRIOR ART-

-PRIOR ART-

-PRIOR ART-

-PRIOR ART-

-PRIOR ART-

-PRIOR ART-

7A, B

CIRCULARLY POLARIZED EVANESCENT MODE RADIATOR

BACKGROUND OF THE INVENTION

The present invention relates, in general, to evanescent mode radiators and, more particularly, to circularly polarized evanescent mode radiators.

Evanescent waveguide mode radiators (EMRs) may be used in phased array antennas because their small electrical size permits close inter-element spacing. Close inter-element spacing is necessary to prevent grating lobes when the antenna beam is steered to large off-broadside scan angles.

EMRs are also useful in applications where low radar cross-section (RCS) of the antenna is desirable since they emulate a low impedance surface at all frequencies below and an octave above a narrow, controllable operating band.

Present EMRs are inherently linearly polarized whereas circular polarization is often required. Presently, circular polarization is provided by exciting two orthogonal modes in a square waveguide cross-section through an external 90 degree hybrid, or by adding a meander-line polarizer across the aperture of the antenna. The former is undesirable in phased array applications where space, part-count, and weight are at a premium. The latter is undesirable since it adds to the thickness of the array and increases the loss and RCS of the antenna. It is also a technically difficult problem to maintain low side lobe levels at wide scan angles when a meander-line polarizer is used to generate circular polarization from a linearly polarized array.

Use of an evanescent mode waveguide as a resonant circuit element is known in the art. See Craven, "Waveguide Below Cutoff: A New Type of Microwave Integrated Circuit", 13 Microwave Journal, Vol. 13 No. 8, p. 51 (August 1970). The use of an evanescent mode waveguide as a linearly polarized antenna element is described in chapter 7 of EVANESCENT MODE MICROWAVE COMPONENTS, Craven & Skedd, (Artech House, 1987).

Circularly polarized evanescent mode radiators are utilized to communicate with a receiving antenna which is not stationary, or for a stationary receiving antenna to communicate with a moving transmitting antenna. This type of radiator would be beneficial to communicate with such items as aircraft and the like. In addition, this can be used to communicate between points where the orientation of one of the antennas may be unknown. Circular polarization can be generated by imposing a 90 degree phase shift between spatially-orthogonal, linearly polarized components.

Since space, or volume, is generally a concern in the design of microwave communication devices, a continuing object in the area of microwave radiators is to provide more compact and lighter weight radiators.

Accordingly, it is an object of the present invention to provide a circularly polarized evanescent mode radiator which overcomes the above deficiencies.

A further object of the present invention is to provide a circularly polarized evanescent mode radiator which is more compact.

Another object of the present invention is to provide a circularly polarized evanescent mode radiator which has a low radar cross-section.

Still another object of the present invention is to provide a circularly polarized evanescent mode radiator which does not require external components such as a 90 degree hybrid.

SUMMARY OF THE INVENTION

A particular embodiment of the present invention comprises a nearly square waveguide below cutoff. The waveguide is excited such that two orthogonal evanescent waves are generated. A microstrip is placed diagonally in the waveguide with a shunt capacitive element adjacent on an end of the microstrip and perpendicular to the microstrip. Alternatively, the shunt capacitive elements may be formed by a pair of posts forming 45 degree angles with the microstrip.

A second preferred embodiment of the present invention consists of a nearly square waveguide below cutoff excited such that two orthogonal evanescent waves are generated. A microstrip is placed diagonally in the waveguide. A shunt capacitive element is formed on the dielectric supporting the microstrip. Each embodiment has a second shunt capacitance formed by a dielectric window at the output face of the waveguide.

DETAILED DESCRIPTION OF THE DRAWINGS

Figure 1A:
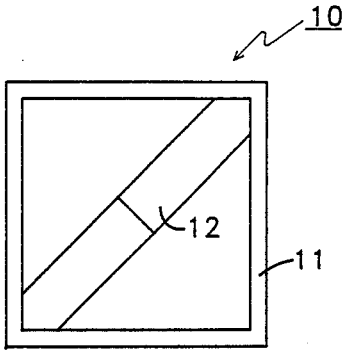
FIGS. 1A and 1B are end and cross-sectional views of a prior art dielectric plate used for circular polarization.
Figure 1B:
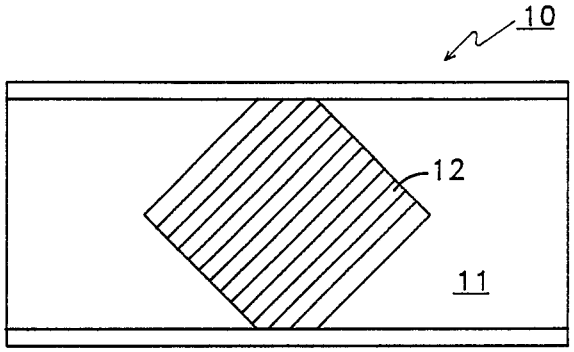

Referring first to FIGS. 1A and 1B, a prior art device, generally designated 10, used to impose a 90 degree phase shift between spatially-orthogonal, linear polarized components is illustrated. Device 10 is a normal (nonevanescent) mode square waveguide using a quarter-wave delay. Device 10 consists of a square waveguide 11 with a quarter wave high dielectric constant plate 12 disposed diagonally therein.

Device 10 has the disadvantage, besides not operating in the evanescent mode, of added weight and space requirements. In addition, device 10 does not have a small electrical size or a low radar cross-section.

Figure 2:
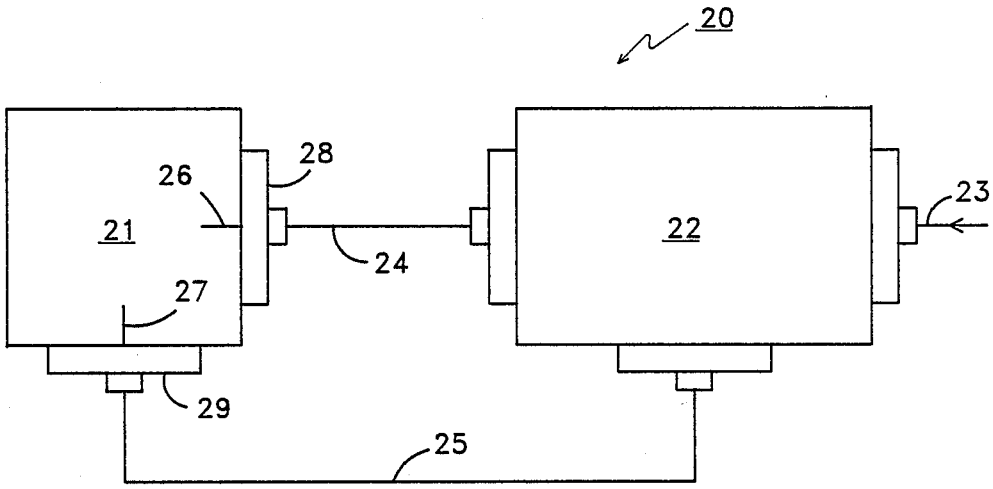
FIG. 2 is a block diagram, having portions broken away, of a prior art device which uses an external 90 degree hybrid and orthogonal probes in a square waveguide for circular polarization.

The device of FIG. 2, generally designated 20, is a prior art 90 degree hybrid used with a square waveguide to provide circular polarization. Device 20 consists of coaxial transmission line input 23, a 90 degree hybrid 22 and a square waveguide 21 to produce a circularly polarized output from waveguide 21. Lines 24 and 25 are equal length transmission lines connecting hybrid 22 to square waveguide 21. Center conductors of coaxial connectors 28 and 29 are extended inside waveguide 21 to form excitation probes 26 and 27.

Device 20 has the same disadvantages as device 10 in that it is not designed to operate in the evanescent mode and adds weight and space to the device. It also does not have a small electrical size or low radar cross-section.

Figure 3A:
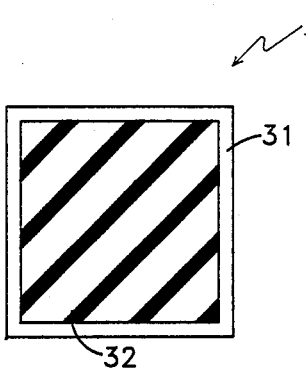
FIGS. 3A and 3B are end and cross-sectional views of a prior art dielectric loaded waveguide.
Figure 3B:
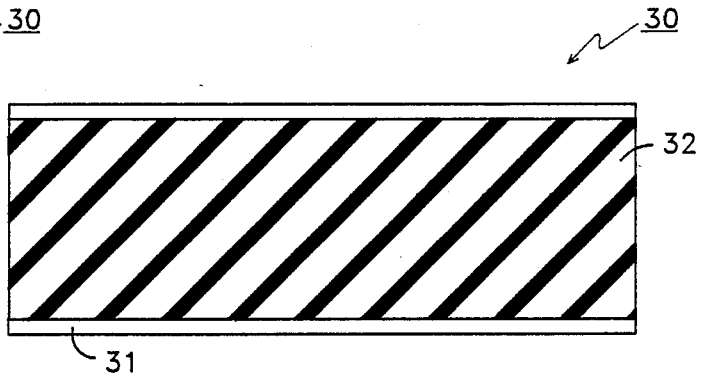

In the prior art, small size has been achieved by dielectric loading of undersized square waveguides. This is illustrated in FIGS. 3A and 3B where a prior art device, generally designated 30, is illustrated. Device 30 consists of a waveguide 31 filled with a dielectric material 32. The disadvantage of device 30 is that a low radar cross-section is not achieved and additional length, weight and space is required to provide the necessary 90 degree phase shift.

Figure 4:
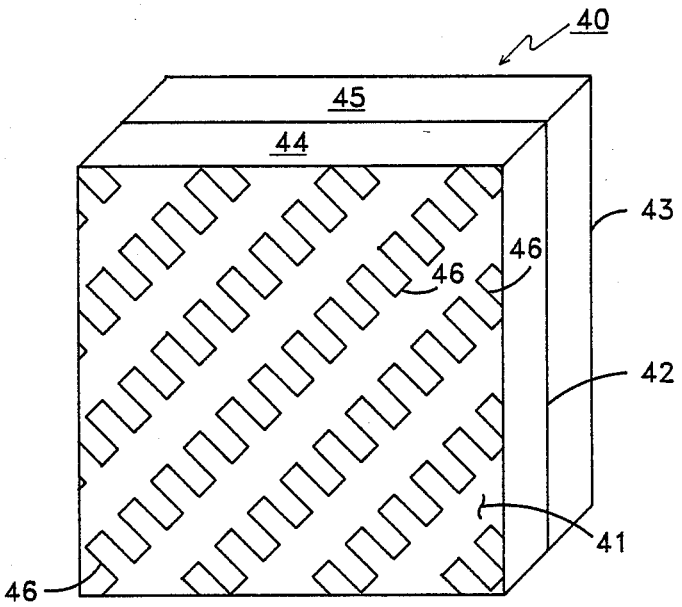
FIG. 4 is a view in perspective of a prior art meander-line polarizer.

Another prior art device, generally designated 40, is illustrated in FIG. 4. Device 40 is a three-layer meander-line polarizer. Device 40 is placed in front of an antenna aperture to achieve circular polarization of the signal. Device 40 comprises three layers 41, 42, and 43 separated by layers of dielectric material 44 and 45. Each of layers 41–43 has a plurality of wires 46 disposed thereon. Device 40 has the drawback of adding thickness to the antenna. In addition, device 40 adds loss and complexity to the antenna array. Device 40 also has a large radar cross-section. Further device 40 can degrade low side lobe performance of an antenna array at wide scan angles.

Figure 5:
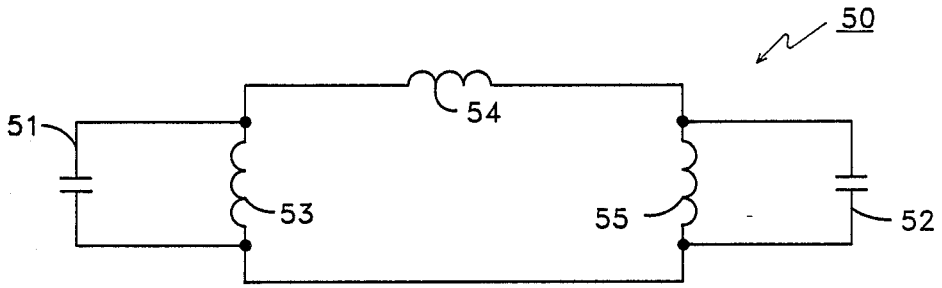
FIG. 5 is an equivalent circuit diagram of an evanescent mode bandpass filter.
Figure 6:
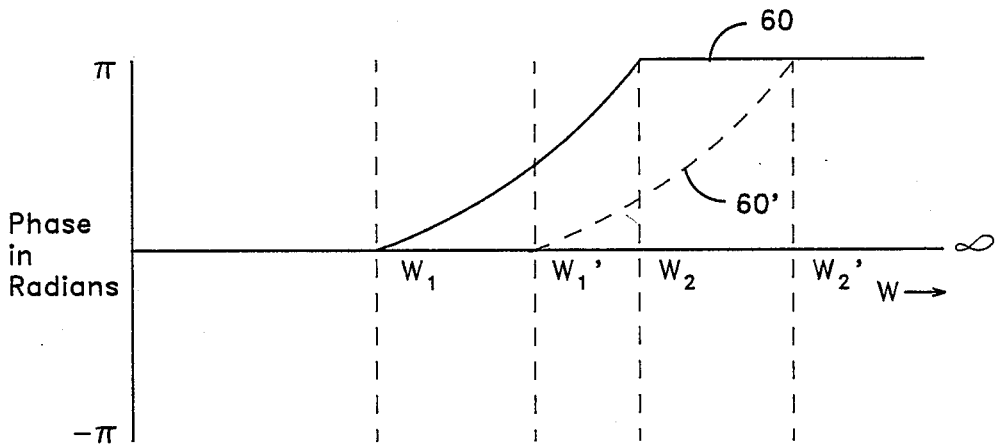
FIG. 6 is a graph of phase vs. frequency for the circuit of FIG. 5.

Referring now to FIG. 5, an equivalent circuit, generally designated 50, of a bandpass filter is illustrated. Filter 50 is formed by adding capacitors 51 and 52 to the equivalent circuit or a waveguide below cutoff, namely a "pi" network, formed by inductors 53–55. FIG. 6 is a graph of a phase response "B" of filter 50 as it varies with frequency "w". The phase response is represented by a line 60 and varies from 0 to pi over the bandpass, from $w_1$ to $w_2$.

As can be seen from FIG. 6, if the bandpass of a spatially orthogonal mode is slightly staggered, $w_1'$ to $w_2'$, the difference in their phases, lines 60 and 60', can be maintained at near 90 degrees between frequencies $w_1'$ to $W_2$.

Figure 7A:
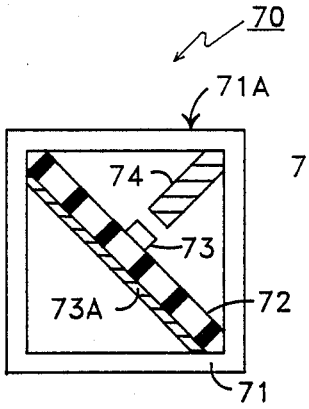
FIGS. 7A and 7B are end and cross-sectional views of a circular polarized evanescent mode radiator embodying the present invention.
Figure 7B:
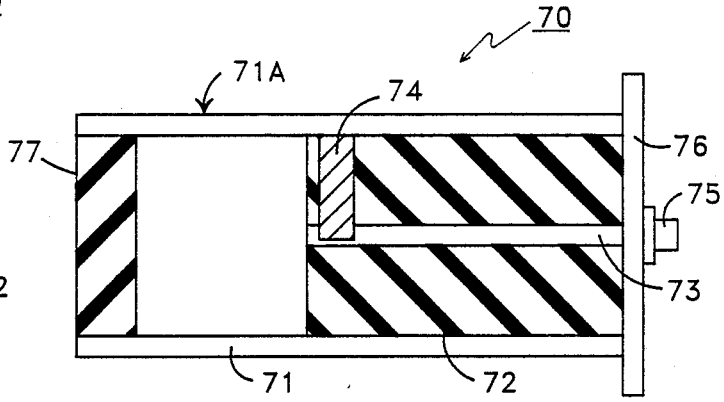

Referring now to FIGS. 7A and 7B, end and cross-sectional views of a circular polarized evanescent mode radiator, generally designated 70, embodying the present invention are illustrated. Radiator 70 consists of a near square waveguide 71 having a microstrip substrate 72 disposed diagonally therein. Disposed on substrate 72 is microstrip 73. Substrate 72 ideally has a ground plane 73A.

Dispose adjacent one end and perpendicularly to microstrip 73 is a metallic capacitive post 74. Capacitive post 74 functions to provide the capacitance represented by capacitor 52, FIG. 5. At the opposite end of microstrip 73 is a connector 75 coupled to waveguide 71 by a flange 76. As would be obvious to one skilled in the art, many other microwave connectors are suitable.

At the opposite end of waveguide 71 which is beyond cutoff is a dielectric window 77. Window 77 provides the capacitance represented by capacitor 51, FIG. 5. The length of cutoff waveguide 71 determines the values of inductors 53, 54 and 55 of FIG. 5. Expressions for the values of inductors 53, 54 and 55 can be found in many well-known references such as "Waveguide Below Cutoff: A New Type of Microwave Circuit", by G. Craven, *Microwave Journal*, pp. 51–58, August, 1970. Values for inductors 53, 54 and 55 and values for capacitances 51 and 52 are chosen such that, in the frequency band of interest, the microstrip line 73 is matched to free space. Matching networks of the form shown in FIG. 5 are well understood and can be designed using, for example, image filter design techniques. In one embodiment which provides effective results, space between the inside face of dielectric window 77 and the end of substrate 72 inside waveguide 70 is 0.147 inches. Thickness of dielectric window 77 is 0.050 inches. Cutoff frequency of waveguide 70 is 6.3 $GH_z$. Resonant band of evanescent mode operation is 3.35 to 3.65 $GH_z$.

In operation, the signal being transmitted along microstrip 73 will be broken into two orthogonal evanescent waves. Because of the difference in dimensions of waveguide 71 (aspect ratio is not equal to 1) the passbands of the two waves will be different. Radiator 70 may be fine tuned by adjusting the capacitances provided by post 74 and window 77 to provide the desired output. The aspect ratio must be close to 1 to maintain relative equality in magnitude of the orthogonal evanescent mode components.

Figure 8:
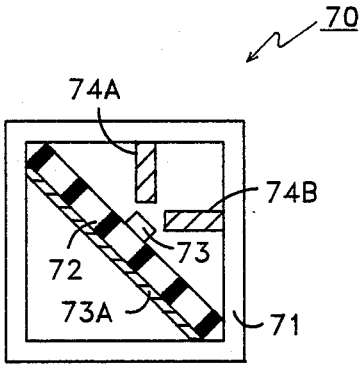
FIG. 8 is an end view of the EMR of FIGS. 7A and 7B illustrating an alternative capacitive post placement.

In FIG. 8, an alternative embodiment of shaft 74 of radiator 70 is illustrated. Replacing metal shaft 74 are a pair of metal capacitive shafts 74A and 74B. These shafts are perpendicular to each other and disposed at 45 degree angles to microstrip 73. This alternative would provide a more independant tuning of the orthogonal modes of radiator 70.

Figure 9:
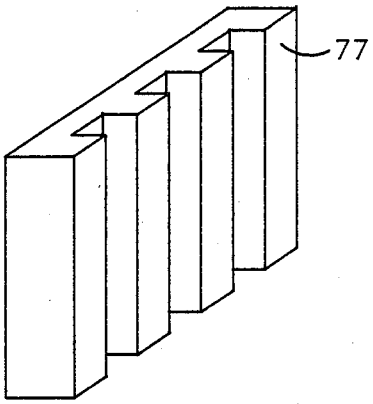
FIG. 9 is a perspective view of an alternative dielectric window for use in the EMR of FIGS. 7A and 7B.

It would also be possible to control the capacitance provided by dielectric window 77 by changing the design. A slotted window 77 is illustrated in FIG. 9. Other designs such as curves, etc. may also be used.

Figure 10:
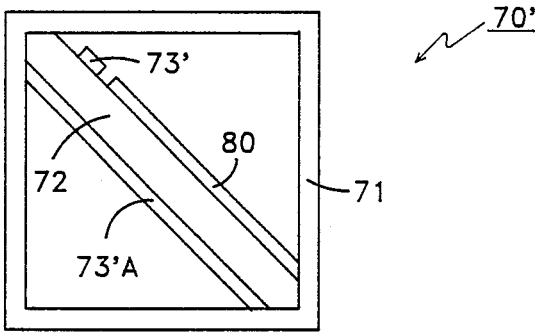
FIG. 10 is an end view of a second embodiment of the present invention.
Figure 11:
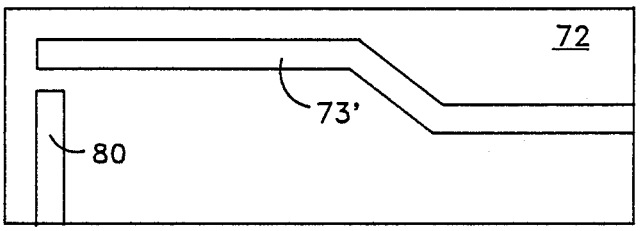
FIG. 11 is a top planar view of the microstrip substrate utilized in the EMR of FIG. 10.

Referring now to FIGS. 10 and 11, a second embodiment of the present invention, generally designated 70', is illustrated. Radiator 70' consists of waveguide 71 having substrate 72 disposed diagonally therein. Disposed on substrate 72 is microstrip 73'. A ground plane 73'A is shown on substrate 72. Also disposed on substrate 72 is a metal shunt 80 which functions as capacitor 52 of FIG. 5. Metal shunt 80 is shown connected electrically to the corner of waveguide 71. Calculations for the shunt capacitance of shunt 80 can be made by those skilled in the art using, for example, equations in "Waveguide Handbook", by N. Marcuvitz, Radiation Laboratory series, McGraw Hill, Vol. 10, Chapt. 5, or using any of several software programs currently available to microwave circuit designers. Since shunt 80 can be formed at the same time as microstrip 73', device 70' is easier to fabricate and requires fewer individual parts.

Figure 12:
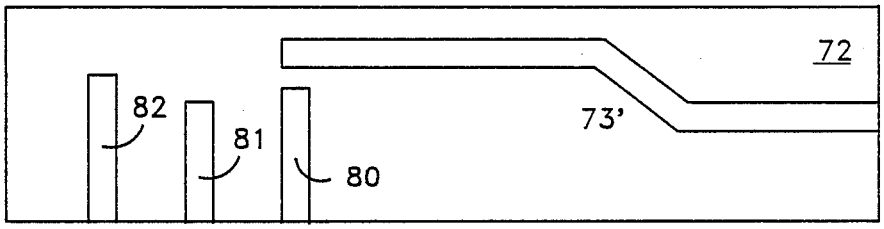
FIG. 12 is a top planar view of an alternative microstrip substrate for use with the EMR of FIG. 10.
Figure 13:
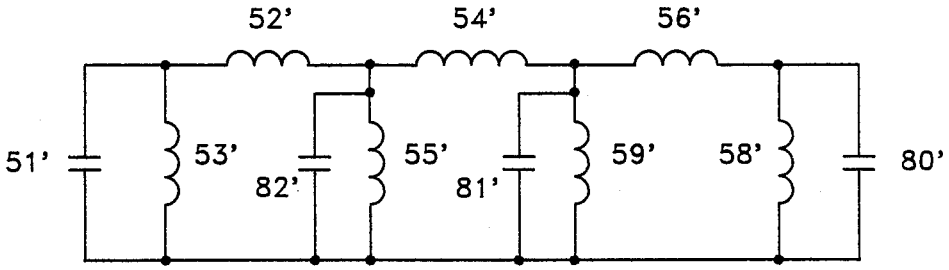
FIG. 13 is an equivalent circuit diagram of a 3-stage evanescent mode waveguide bandpass filter.

FIG. 12 illustrates a modification of the design of FIG. 11. In the design of FIG. 12, metal shunt capacitors 81 and 82 have been added each electrically connected to the corner of waveguide 71 (FIG. 10). Metal posts such as 80–82, when aligned perpendicular to the E-field in the waveguide, act as capacitors. Capacitors 81 and 82 provide additional stages of filtering of the device. The equivalent circuit of FIG. 12 is shown in FIG. 13. Capacitors 80–82 combine to form the capacitance of capacitors 80', 81' and 82' of FIG. 13.

FIG. 13 is a 3-stage bandpass filter, inductances 52'–58' represent the circuit of an extended length evanescent mode waveguide. Capacitance 51' results from a dielectric window 77 shown in FIGS. 7B and 9.

Thus, it will be apparent, upon reviewing this specification, to one skilled in the art that there has been provided in accordance with the invention, an apparatus and method that fully satisfies the objects, aims, and advantages set forth above.

While the invention has been described in conjunction with specific embodiments thereof, it is evident that many alterations, modifications, and variations will be apparent to those skilled in the art in light of the foregoing description. Accordingly, it is intended to embrace all such alterations, modifications, and variations in the appended claims.

We claim:

1. An evanescent mode radiator comprising:
- a waveguide operating below its cutoff frequency;
- a dielectric substrate disposed diagonally in said waveguide;
- a first conductor disposed on a surface of said dielectric substrate;
- shunt capacitive means disposed in said waveguide adjacent said first conductor; and
- a dielectric window disposed in an end of said waveguide.

2. The radiator of claim 1 wherein said waveguide is a rectangular waveguide.

3. The radiator of claim 2 wherein orthogonal sides of said rectangular waveguide are nearly equal in length.

4. The radiator of claim 1 wherein said shunt capacitive means comprises a conductive post disposed perpendicular to said dielectric substrate.

5. The radiator of claim 1 wherein said shunt capacitive means comprises:
- a first conductive post disposed perpendicular to a first wall of said waveguide; and
- a second conductive post disposed perpendicularly to a second wall of said waveguide and orthogonally to said first conductive post.

6. The radiator of claim 1 wherein said shunt means comprises a second conductor disposed on said surface of said dielectric substrate perpendicular to said first conductor.

7. An evanescent mode radiator comprising:
- a waveguide operating below its cutoff frequency;
- a dielectric substrate disposed diagonally in said waveguide;
- a first conductor disposed on and electrically coupled to a surface of said dielectric substrate;
- a conductive post disposed perpendicular to said dielectric substrate; and
- a dielectric window disposed in an end of said waveguide.

8. The radiator of claim 7 wherein said waveguide is a rectangular waveguide.

9. The radiator of claim 8 wherein orthogonal sides of said rectangular waveguide are nearly equal in length.

10. An evanescent mode radiator comprising:
- a waveguide operating below its cutoff frequency;
- a dielectric substrate disposed diagonally in said waveguide;
- a first conductor disposed on and electrically coupled to a surface of said dielectric substrate;
- a first conductive post disposed perpendicular to a first wall of said waveguide;
- a second conductive post disposed perpendicularly to a second wall of said waveguide and orthogonally to said first conductive post; and
- a dielectric window disposed in an end of said waveguide.

11. The radiator of claim 10 wherein said waveguide is a rectangular waveguide.

12. The radiator of claim 11 wherein orthogonal sides of said rectangular waveguide are nearly equal in length.

13. An evanescent mode radiator comprising:
- a waveguide operating below its cutoff frequency;
- a dielectric substrate disposed diagonally in said waveguide;
- a first conductor disposed on a surface of said dielectric substrate and connected electrically to said waveguide;
- a second conductor disposed on said surface of said dielectric substrate perpendicular to said first conductor and connected electrically to said waveguide; and
- a dielectric window disposed in an end of said waveguide.

14. The radiator of claim 13 wherein said waveguide is a rectangular waveguide.

15. The radiator of claim 14 wherein orthogonal sides of said rectangular waveguide are nearly equal in length.

* * * * *